United States Patent [19]

Seidel

[11] 4,130,949

[45] Dec. 26, 1978

[54] FASTENING MEANS FOR SPORTS SHOES

[75] Inventor: Sigurd Seidel, Graz, Austria

[73] Assignee: Skischuhfabrik Dynafit Gesellschaft, Graz, Austria

[21] Appl. No.: 760,993

[22] Filed: Jan. 21, 1977

[30] Foreign Application Priority Data

Jan. 22, 1976 [AT] Austria ..... 413/76

[51] Int. Cl.[2] ..... A43B 11/00; A43C 1/00

[52] U.S. Cl. ..... 36/50; 24/170; 24/149; 24/143 R; 24/120

[58] Field of Search ..... 24/120, 149, 140, 117, 24/226, 68 E, 68 SK, 141, 170, 144, 145, 146, 147; 36/50, 117

[56] References Cited

U.S. PATENT DOCUMENTS

| | | | |
|---|---|---|---|
| 74,367 | 2/1868 | Hurd | 24/170 |
| 348,604 | 9/1886 | Wilson | 24/149 |
| 353,842 | 12/1886 | Bristol | 24/170 |
| 724,716 | 4/1903 | Kuehlhorn | 24/141 |
| 1,060,422 | 4/1913 | Bowdish | 24/120 |
| 1,094,357 | 4/1914 | Ayres | 24/149 |
| 1,481,903 | 1/1924 | Hart | 24/117 R |
| 2,191,210 | 2/1940 | Johnson | 24/191 |
| 2,318,411 | 5/1943 | Moore | 24/117 R |
| 3,510,919 | 5/1970 | Chernuchin | 24/191 |
| 3,641,633 | 2/1972 | Leavenworth | 24/191 |

FOREIGN PATENT DOCUMENTS

| | | | |
|---|---|---|---|
| 194277 | 1/1908 | Fed. Rep. of Germany | 24/120 |
| 677178 | 3/1930 | France | 24/191 |
| 778606 | 3/1935 | France | 24/170 |
| 1404799 | 5/1965 | France | 24/149 |
| 320621 | 8/1934 | Italy | 36/50 |
| 558 of | 1861 | United Kingdom | 36/50 |
| 19418 of | 1896 | United Kingdom | 24/191 |
| 11956 of | 1897 | United Kingdom | 24/170 |

*Primary Examiner*—Bernard A. Gelak
*Attorney, Agent, or Firm*—Fleit & Jacobson

[57] ABSTRACT

Fastening means for sports shoes comprise a lace, a tension cable or the like, which is guided over guide elements which consists of buckles and are provided with rollers or the like. One end of the lace is provided with a detachable, spring-loaded one-way clip, in which the other end of the lace is movable in the direction in which it is pulled but fixed in the opposite direction.

4 Claims, 3 Drawing Figures

FASTENING MEANS FOR SPORTS SHOES

SUMMARY OF THE INVENTION

Fastening means for sports shoes comprise a lace, which is arranged in a crossing pattern and is reversed at buckles provided with rollers and is held together at its ends by a one-way clip, which is secured to one end of the lace whereas the other end of the lace extends through the one-way clip.

This invention relates to fastening means for sports shoes. These fastening means comprise a lace, a tension cable or the like, which is guided over guide elements.

These fastening means are mainly intended for skiing boots for cross-country skiing.

Skiing boots for Alpine skiing are often heavy and in most cases fastened by means of buckles. Older boots for this purpose comprise an inner boot provided with rows of eyelets for one lace and an outer boot provided with rows of hooks for another lace. The lace strings, straps or the like are threaded through these eyelets and hooks in crossing patterns. Boots provided with such fastening means have the disadvantage that it is complicated and time-consuming to tighten the lacing because the lace must be pulled tight after each crossing and will unintendedly loosen as the next crossing is formed. As a result, a proper fit of the boot often cannot be ensured. This disadvantage of the known fastening means has a particularly undesirable influence on the performance of boots intended for cross-country skiing, which are much lighter than skiing boots for Alpine skiing and fit the foot more closely.

It is an object of the invention to avoid this disadvantage. This is accomplished according to the invention in that the guide elements consist of buckles, which are provided with rollers and, in accordance with a further feature of the invention, one end of the lace is provided with a detachable, spring-loaded one-way clip, in which the other end of the lace is movable in the pulling direction and fixed in the opposite direction. Such buckles present only a slight resistance to the pulling of the lace so that tension applied to the ends of the lace arranged in a crossing pattern will be transmitted as far as to the toe end of the lace and the tension will be uniformly distributed throughout the length of the lace. Owing to the combination of the clip and the buckles, the entire lace arranged in a crossing pattern can be uniformly tensioned simply by a pull on that end of the lace which extends through the one-way clip.

Further details of the invention will be explained more fully with reference to the drawing, in which an embodiment of fastening means according to the invention is shown by way of example.

Figure 1:
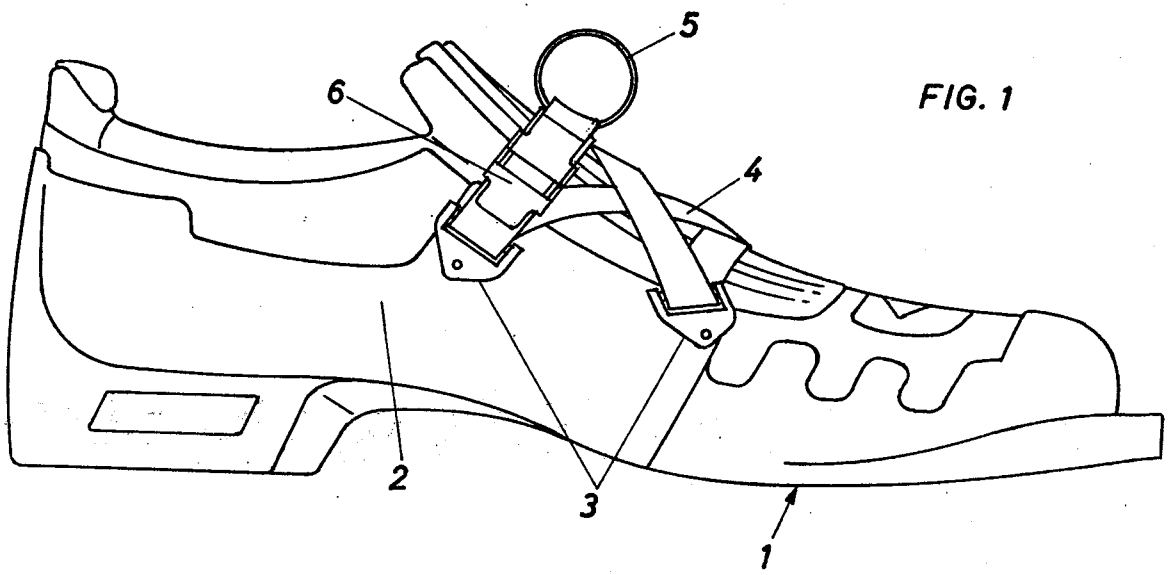
FIG. 1 is a perspective view showing a skiing boot for cross-country skiing, which is provided with fastening means according to the invention.
Figure 3:
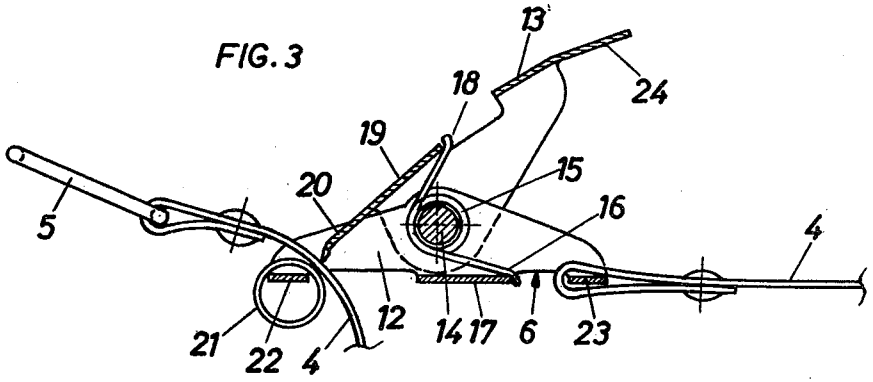
FIG. 3 is a transverse sectional view showing the one-way clip.
Figure 2:
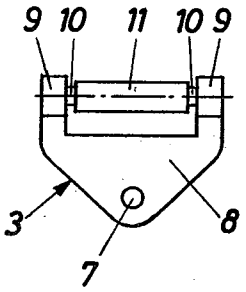
FIG. 2 is an enlarged top plan view showing the buckle.

A skiing boot 1 for cross-country skiing has an upper 2, which extends as far as to the ankle region and is provided with buckles 3 arranged in two rows of two buckles and engaged by a lace strap 4, which extends in a crossing pattern from the pair of buckles which are nearer to the toes and through the succeeding pair of buckles and any additional pair or pairs of buckles and is provided at one end with a ring 5. At its other end, the lace strap 4 carries a one-way clip 6, through which that end of the strap extends which is provided with the ring 5.

Each buckle 3 comprises a plate member 8, which comprises prongs 9, which form a fork, and is pivoted to the upper by a rivet 7 or the like. The prongs 9 have coiled end portions forming bearings for end journals 10 of a roller 11 for guiding the strap 4.

The one-way clip 6 consists of a frame 12 and a double-armed lever 13, which is pivoted to the frame 12 and biased by a coil spring 15, which is coiled around the pivot pin 14 of the lever 13. Bearing at one end 16 on an intermediate web 17 of the frame 12 and at the other end 18 on a web 19 of the lever 13, the spring 15 urges one arm 20 of the lever 13 against a roller 21, which is rotatably mounted on an end web 22 of the frame 12, which is provided with another web 23 at its opposite end. That end of the lace strap 4 which carries the oneway clip 6 has been formed into a loop, which extends around the web 23. That end of the strap which carries the ring 5 is guided between a serrated edge of the arm 20 of the lever 13 and the roller 21. To re-tighten the lace strap 4, it is sufficient to exert a pull on the ring 5. The lace strap will be retained in any pulled position by the lever 13. When it is desired to relax the strap 4, pressure can be applied to that arm 24 of the lever 13 which is remote from the roller 21 so that the force of the spring 15 is overcome, the arm 20 disengages the lace strap 4, and the latter can now be loosened as desired.

What is claimed is:

1. Fastening means for a sports shoe, comprising a flexible lace, a plurality of buckles, a one-way clip, and mounting means for mounting each of said plurality of buckles to respective portions of an upper of a shoe at the points of reversal of the lace, said mounting means having axes generally perpendicular to the upper of the shoe and each of said plurality of buckles being pivotable about a respective one of said axes, each of said plurality of buckles being provided with a rotatably mounted roller having an axis generally parallel to the upper of the shoe for guiding the lace when said buckle is mounted on a sports shoe, said one-way clip having a frame member secured to one end of the lace and being provided with guide means for guiding the other end of the lace through said one-way clip so as to permit the same to move in a direction in which tension is applied to tighten the flexible lace, said guide means including releasable locking means for preventing an unintended return movement through said one-way clip of the guided end of the lace, said releasable locking means including a double-arm lever and a spring having one end bearing on said frame member and the other end bearing on one arm of the double-arm lever for biasing said one arm into locking engagement with said guided end of said lace.

2. Fastening means as claimed in claim 1, wherein the one-way clip further includes a roller rotatably mounted on said frame member, the guided end of said flexible lace being releasably locked between said roller and said one arm of said double-arm lever.

3. Fastening means as claimed in claim 1, wherein said guided end of said flexible lace includes a ring member for pulling said guided end of said lace through said one-way clip.

4. Fastening means as claimed in claim 1 wherein each of said buckles includes two spaced-apart prongs for mounting end portions of the rotably mounted rollers.

* * * * *